US005092513A

United States Patent [19]

Arbonies

[11] Patent Number: 5,092,513

[45] Date of Patent: Mar. 3, 1992

[54] VARIENT ENVELOPE

[76] Inventor: Martin S. Arbonies, 5 Rochester Ct., Huntington, N.Y. 11743

[21] Appl. No.: 576,979

[22] Filed: Sep. 4, 1990

[51] Int. Cl.[5] ..... B65D 27/00

[52] U.S. Cl. ..... 229/68 R; 229/1.5 R; 229/DIG. 3

[58] Field of Search ..... 229/68 R, 1.5 R, DIG. 3

[56] References Cited

U.S. PATENT DOCUMENTS

| | | | |
|---|---|---|---|
| 652,246 | 6/1900 | Chapin | 229/68 R |
| 669,598 | 3/1901 | Sharp | 229/68 R |
| 753,943 | 3/1904 | Walsh . | |
| 847,648 | 3/1907 | Carnahan | 229/1.5 R |
| 897,778 | 9/1908 | Post | 229/68 R |
| 2,356,078 | 8/1944 | Myers | 229/68 R |
| 2,883,989 | 4/1959 | Ulrich | 229/1.5 R |
| 2,949,223 | 8/1960 | Eichenlaub | 229/68 R |
| 3,578,791 | 5/1971 | Davis | 229/68 R |
| 4,893,745 | 1/1990 | Weber et al. | 229/1.5 R |

*Primary Examiner*—Stephen P. Garbe
*Assistant Examiner*—Jes Pascua
*Attorney, Agent, or Firm*—Leonard Belkin

[57] ABSTRACT

A mailing envelope for being stuffed with a bulky insert comprising a rectangular envelope having cutouts formed in the bottom two corners, the cutouts being cut in a straight line at a 45 degree angle to an edge, and the depth measured along an edge from the corner being no more than 0.158 of the height of the envelope. In another embodiment of the invention, slits along a diagonal are utilized instead of the cutouts.

2 Claims, 2 Drawing Sheets

VARIENT ENVELOPE

BACKGROUND OF THE INVENTION

This invention relates to a mailing envelope and more particularly to a mailing envelope with improved stuffing characteristics.

Machine enclosing of large quantities of mail requires envelopes of sufficient capacity. Some envelopes are made considerably larger than the media planned for enclosure while others provide pleated ends to allow for greater opening of the envelope to accommodate larger contents due to the difficulty of opening the conventional mailing envelope wide enough to receive the inserts. As size and complexity increase, the cost increases accordingly.

The stuffing of bulky material into envelopes for mailing is generally done by hand because the corners of the envelope tend to resist full opening of the envelope, and a positive effort is required to make the insertion of the contents to overcome the friction present since gravity or other conventional mechanical means can not be relied upon for consistent, complete insertion of the contents.

The presence of the corners of the envelope interferes with the use of suction on the sides of the envelope to fully open the envelope so that machine filling of the envelopes is not practical. As a result of the preceding, manual stuffing of envelopes with bulky material is still in general use with the consequence that such activity is expensive and not efficient.

In U.S. Pat. No. 753,943 there is shown a mailing envelope with a corner missing to permit the use of two envelopes to prevent the exposure of the name of the writer.

U.S. Pat. No. 897,778 discloses an envelope with a notch to permit the envelope to be used for both mailing and filing.

U.S. Pat. No. 2,356,078 shows an envelope for holding metallic objects for dipping into rust-resisting solutions, open corners being provided to permit the excess solution to run out. The patented envelope is not a mailing envelope.

U.S. Pat. No. 2,949,223 illustrates a file and mail envelope. In this arrangement, the flaps are designed so that when the envelope is opened it can be used as a folder for filing.

U.S. Pat. No. 3,578,791 discloses an envelope with a triangular cutout at one corner so that when the insert is removed it will slice open the envelope.

None of the preceding patents teaches or suggests the present invention.

SUMMARY OF THE INVENTION

In the present invention there is provided a mailing envelope constructed in a manner to facilitate the machine filling or stuffing of the envelope with bulky inserts.

An envelope constructed according to the principles of this invention provides an inexpensive envelope which for its size provides a much larger opening from top to bottom of the envelope for enclosure, with the opening at the lower extremity of the envelope equal to the opening at the top of the envelope so that no resistance however slight is encountered by the entering media.

A preferred embodiment of the invention consists of an envelope having a closed bottom and side edges and an open top with a flap. The bottom two corners at the ends of the bottom edge are cut away so that the side walls of the envelope are more readily separated to permit the bulky insert to be dropped or placed into the envelope.

In another embodiment of the invention the mailing envelope is provided with oppositely facing, diagonally arranged slits on both sides of both bottom corners. This arrangement also facilitates the filling of the envelope with a bulky insert.

It is thus a principal object of this invention to provide a mailing envelope which is machine stuffable with bulky inserts.

Other objects and advantages of this invention will hereinafter become obvious from the following description of preferred embodiments of this invention.

DESCRIPTION OF THE PREFERRED EMBODIMENTS

Figure 1:
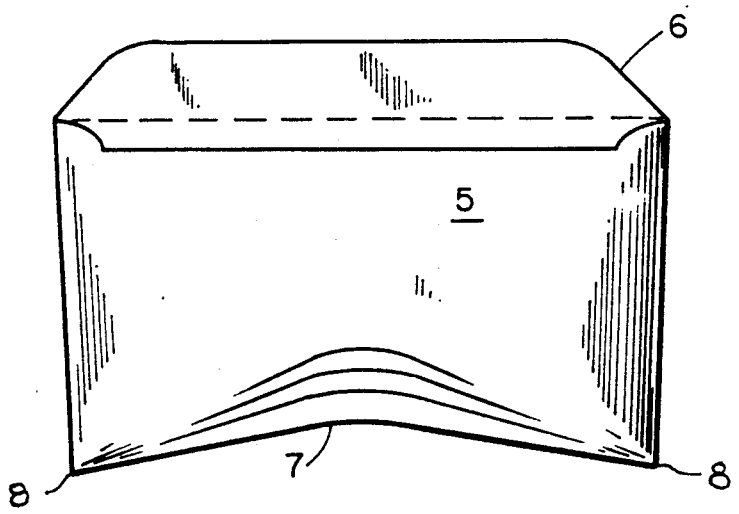
FIG. 1 is a front view of a conventional envelope opened to receive a bulky insert.

Referring to FIG. 1, envelope 5 is of conventional design made of paper having a flap 6 which is open at the top in preparation for inserting a bulky package of material (not shown). It will be noted that the bottom of the envelope at 7 is pushed up to accomodate the separation of the side walls which narrow down to corners 8.

It has been found that in the use of envelope 5 to receive a bulky insert, such insert has to be pushed in manually because the material will not drop by gravity all the way into the envelope due to resistance around the bottom corners of the envelope. Consequently, it is not feasible to employ machine filling of such envelopes.

Figure 2:
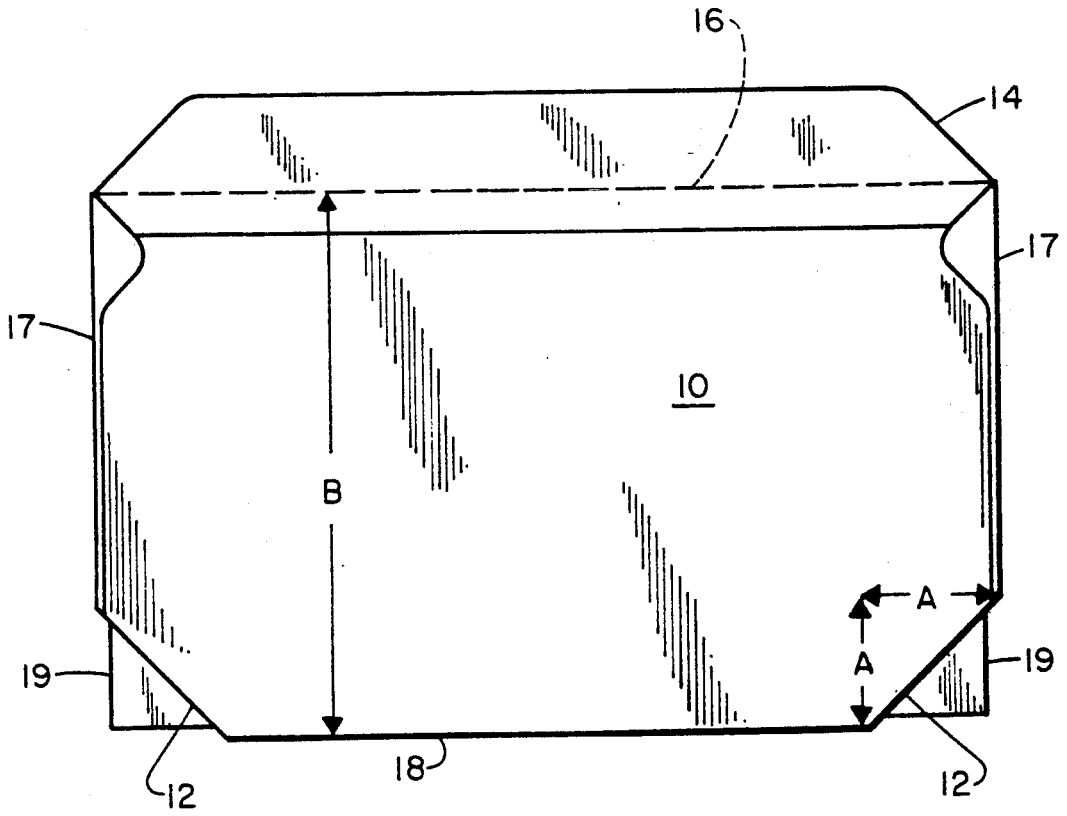
FIG. 2 is a front view of an unsealed envelope which is a preferred embodiment of this invention containing a bulky insert.

Referring to FIG. 2, envelope 10 embodying the principles of this invention is identical to envelope 5 except that the lower corners are cut off forming cutouts 12 at 45 degree angles to the sides. Envelope 10 is provided with a flap 14 foldable along fold line 16 to close the envelope as is understood in the art, with closed side edges 17 and a closed bottom edge 18. It will be seen that the corners of the contents 19 protrude from cut outs 12.

Figure 3:
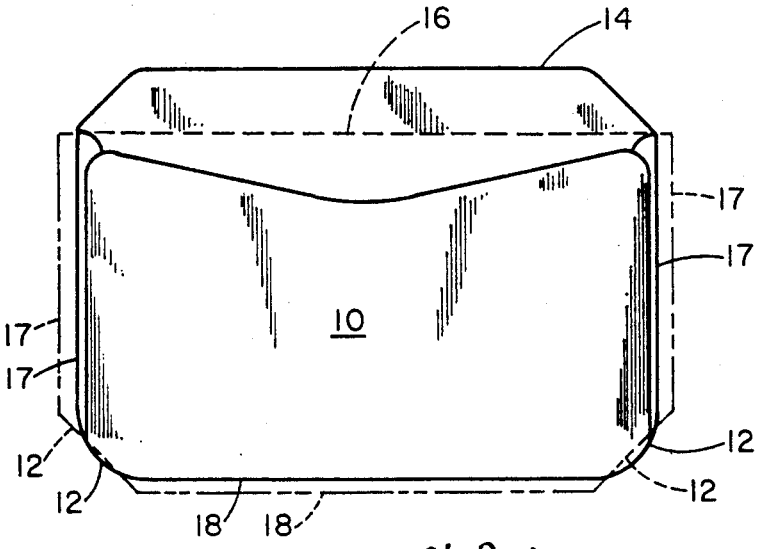
FIG. 3 is a view similar to that of FIG. 1 with the use of the preferred embodiment of this invention.
Figure 4:
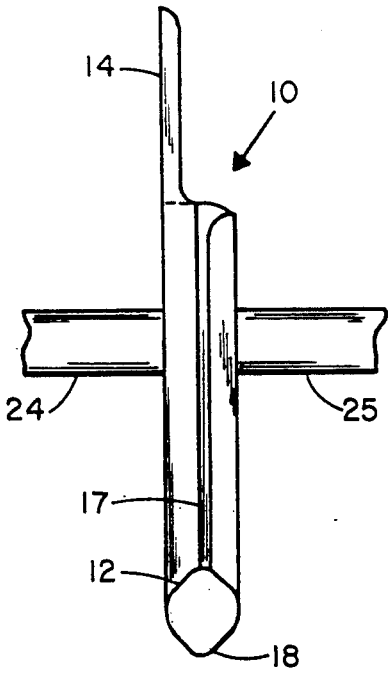
FIG. 4 is an end view of the envelope shown in FIG. 3 showing schematically the use of vacuum to open the envelope.

As seen in FIGS. 3 and 4, when the top of envelope 10 is opened to receive its insert, bottom edge 18 remains straight instead of being distorted as shown for the conventional envelope seen in FIG. 1, but is raised slightly. Side edges 17 move slightly inwardly so that the opening of the envelope at the bottom adjacent edge 18 is equal in width to the opening at the top, the entry point of the insert.

The presence of cutouts 12 permits the bottom and side edges 18 and 17 to tend to flatten out as seen in FIG. 4 to produce an opening into envelope 10 which accomodates the insert without the need for any pushing to overcome frictional resistance.

In FIG. 4 is shown schematically the use of vacuum tubes 24 and 26 which can be conveniently used to open envelope 10 uniformly for machine loading.

It has been found that for the use of cutouts 12 to work effectively, they must be at or about 45 degrees as illustrated (that is, the removed edge along the side must equal the removed edge along the bottom) and the ratio of the distance A to B, seen in FIG. 2 must be at least 0.158.

Figure 5:
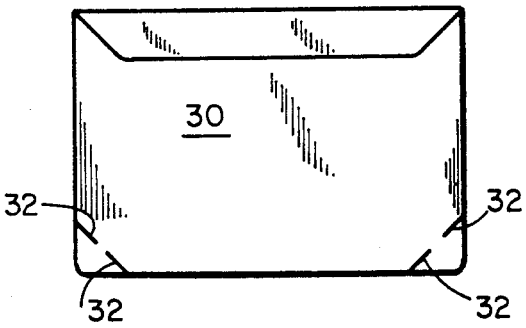
FIG. 5 is a front view of an alternative embodiment of this invention.

In those situations where it may not be desired to expose the corners of the inserted material, the embodiment shown in FIG. 5 may be employed. Envelope 30 similar to envelope 5 shown in FIG. 1 is provided with a pair of slits 32 at each of the bottom corners as illustrated. Slits 32 are straight, aligned with each other at each corner, and placed at a 45 degree angle as are cutouts 12 previously described. The same minimum ratio of at least 0.158 applies in this embodiment as well. This arrangement provides an improved opening over that of the conventional envelope shown in FIG. 1 although not obtaining the full advantages obtained from the use of the cutouts.

There has thus been described and illustrated a new and novel envelope design of inexpensive and economical construction which for a given size provides a much larger opening from top to bottom of the envelope for enclosure.

While only certain preferred embodiments of this invention have been disclosed, it is understood that many variations are possible without departing from the principles of this invention as defined in the claims which follow.

What is claimed is:

1. A mailing envelope of flexible material comprising front and rear walls of generally rectangular shape having closed bottom and side edges forming corners at both ends of said bottom edge, said envelope being open at the top for stuffing a bulky insert, a pair of slits being formed at each of said corners by slicing each said corner from both the side and bottom edge along a straight line at a 45 degree angle to said bottom edge, said slits terminating at points separated from each other so that said corners remain in place, said slits permitting said front and rear walls to be separated without distortion of said bottom edge.

2. The envelope of claim 1 in which the distance from a corner to the beginning of said slit is no more than about 0.158 of the height of said envelope measured from said bottom edge to the top of said opening into said envelope.

* * * * *